US005238294A

United States Patent [19]

Ishi et al.

[11] Patent Number: 5,238,294

[45] Date of Patent: Aug. 24, 1993

[54] INTERLOCKING MECHANISM FOR SUPPORTING SEAT AND SEAT BACK OF CHAIR

[75] Inventors: Yuji Ishi; Toru Nagao, both of Osaka; Hironaga Obata, Tokyo; Yasuo Uematsu, Tokyo; Tetsuya Kano, Tokyo, all of Japan

[73] Assignee: Itoki Co., Ltd., Osaka, Japan

[21] Appl. No.: 770,473

[22] Filed: Oct. 3, 1991

[30] Foreign Application Priority Data

May 21, 1991 [JP] Japan ..... 3-144073

[51] Int. Cl.[5] ..... A47C 1/032

[52] U.S. Cl. ..... 297/301; 297/304

[58] Field of Search ..... 297/301, 304, 300

[56] References Cited

U.S. PATENT DOCUMENTS

| | | | |
|---|---|---|---|
| 217,584 | 7/1879 | Chichester | 297/301 |
| 4,640,548 | 2/1987 | Desanta | 297/301 X |
| 4,776,633 | 10/1988 | Knoblock et al. | 297/301 X |
| 4,986,601 | 1/1991 | Inoue | 297/301 |
| 5,114,211 | 5/1992 | Desanta | 297/301 |

FOREIGN PATENT DOCUMENTS

| | | | |
|---|---|---|---|
| 105955 | 4/1984 | European Pat. Off. | 297/301 |
| 2929428 | 1/1981 | Fed. Rep. of Germany | 297/301 |

*Primary Examiner*—Peter R. Brown

*Attorney, Agent, or Firm*—Rogers & Killeen

[57] ABSTRACT

There is provided an interlocking supporting mechanism for supporting the seat and seat back of a chair, particularly an office chair. In the supporting mechanism a link system is utilized to interlock the seat with the seat back, so that the chair is capable of smoothly moving as a seated person moves.

The front portion of a lever member is pivotally connected to the front portion of a frame member which is supported by a fixing member and which extends toward the front portion of the seat. The lever member is attached, with the aid of horizontal shafts on the right-hand and left-hand sides of the seat, to the lower portions of back supporting bars. A spring member is provided between the frame member and the lever member so that the lever member is rocked on the horizontal shafts. A member for receiving the seat includes a front seat-receiving member and a back seat-receiving member. The front seat-receiving member is provided with the aid of an elastic member so that it can move up and down and right and left, on the front portion of the frame member. The back seat-receiving member is provided, with the aid of shafts parallel with the horizontal shafts, on the back portion of the lever member so that it can rock on these shafts. The seat is supported by the front and back seat-receiving members.

10 Claims, 5 Drawing Sheets

INTERLOCKING MECHANISM FOR SUPPORTING SEAT AND SEAT BACK OF CHAIR

BACKGROUND OF THE INVENTION

1. Field of the Invention

The present invention relates to a mechanism for supporting the seat and seat back of a chair, particularly an office chair. This mechanism interlocks with the seat and seat back.

2. Description of the Related Art

There have recently been proposed from the viewpoint of human engineering various types of mechanisms for supporting the seats and seat back portions of chairs, the main components, which govern the feeling of comfort, so as to move as a seated person moves. There have also been proposed office chairs employing such mechanisms.

Such a supporting mechanism and a chair employing this mechanism have been proposed because the seat and seat back portion of the chair move smoothly without trouble as the posture of a seated person changes, so that comfort is improved, and because the person sitting in this type of chair does not tire much even after he is engaged in various types of work, such as desk work.

In most of such chairs, link systems are utilized to connect the operation of seats to that of seat backs.

When this type of chair commercially available is put into practical use, however, it does not operate smoothly, or operating characteristics cannot be obtained in which the chair moves as the posture of a seated person changes.

SUMMARY OF THE INVENTION

In view of the above disadvantages, the object of the present invention is to provide an interlocking mechanism for supporting the seat and seat back of a chair, particularly an office chair, in which supporting mechanism a link system is utilized to interlock the seat with the seat back, so that the chair is capable of smoothly moving as a seated person moves.

In order to achieve the above object, the present invention provides an interlocking supporting mechanism for a seat and a seat back of a chair, wherein a front portion of a lever member attached, with the aid of horizontal shafts on right-hand and left-hand edges of the seat, to lower portions of back supporting bars is pivotally connected to a front portion of a frame member supported by a fixing member, such as a leg support, and extending toward a front portion of the seat, wherein a repulsive member, such as a spring is provided between the frame member and the lever member so that the repulsive member acts where the lever member is rocked upwardly on the horizontal shafts, wherein a member for receiving the seat includes a front seat-receiving member and a back seat-receiving member, the front seat-receiving member, for receiving a front portion of the seat, being provided with the aid of an elastic member, such as a spring, so that the front seat-receiving member can move up and down and right and left, on the front portion of the frame member, the back seat-receiving member, for receiving a back portion of the seat, being provided, with the aid of shafts parallel with the horizontal shafts, on a back portion of the lever member so that the back seat-receiving member can rock on these shafts, and wherein the seat is supported by the front and back seat-receiving members.

The front and back seat-receiving members are provided on the lever member and the frame member, respectively. The lever member is connected to the ends of the back supporting bars, and the frame member supports, with the aid of the horizontal shafts, the lever member so as to rock. The front and back portions of the seat are supported independently of the lever member and the frame member. The front portion of the seat is supported by the front seat-receiving member separately from the back portion of the seat supported by the back seat-receiving member. Even in a structure in which the seat is integrally formed with the seat back supported by the back supporting bars, the back seat-receiving portion is supported in a position in which it is not moved back and forth. The front portion of the seat and the seat back integral with the back portion of the seat move independently of each other.

DESCRIPTION OF THE PREFERRED EMBODIMENT

Figure 1:
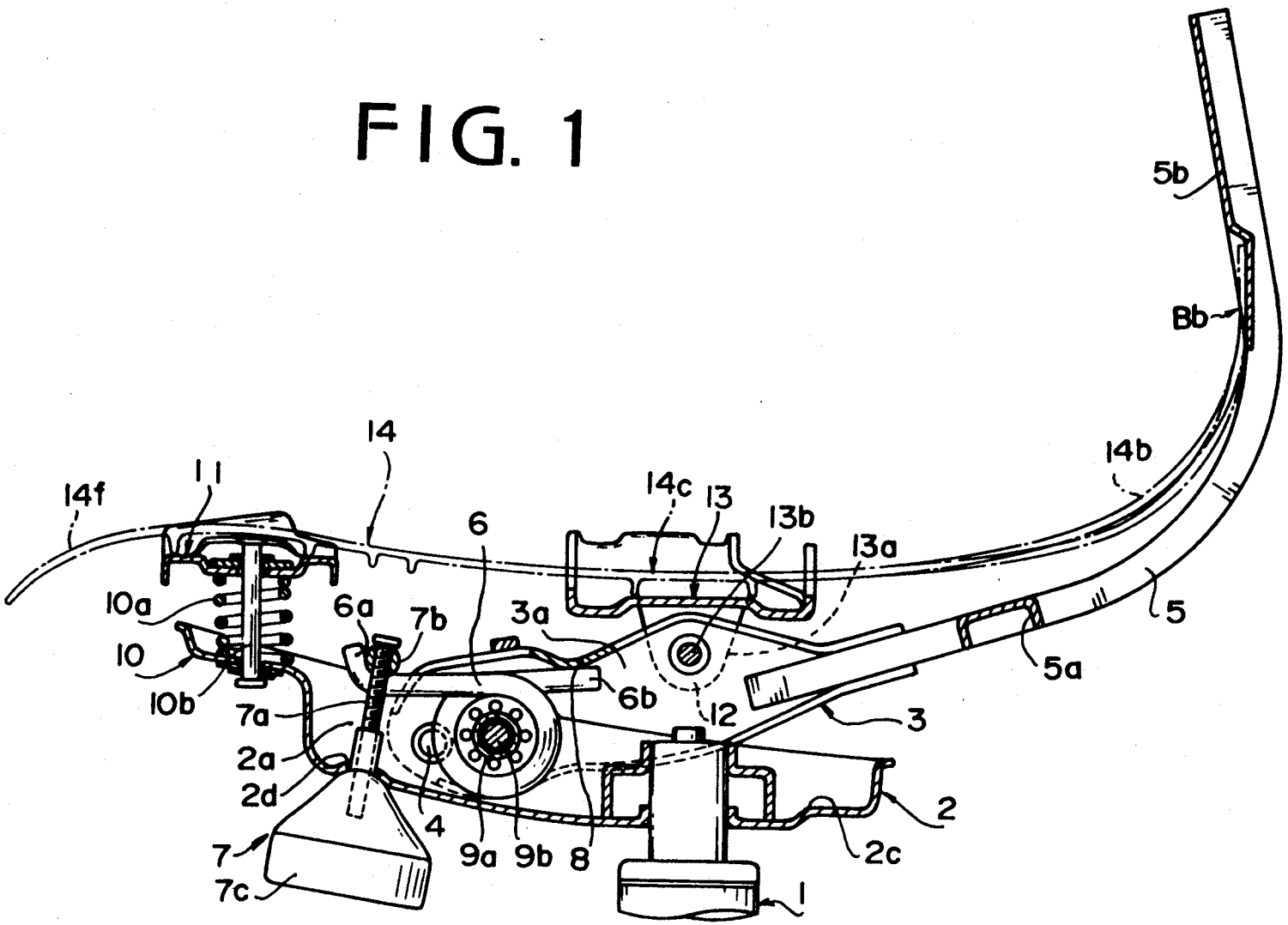
FIG. 1 is a side view, partially shown in cross section, of a mechanism in accordance with an embodiment of the present invention.

The preferred embodiment of the present invention will be described below with reference to the accompanying drawings.

In the drawings, numeral 1 denotes a cylindrical leg support of a swivel office chair, which, though not shown in detail, has a plurality of legs extending radially at the lower end thereof A means for adjusting the height of the seat is provided inside the support, this means being operable as, for example, by a gas spring. A frame member 2 and the like, described later, are attached to the support 1, which is a fixing member.

Numeral 2 denotes a shallow box-like frame member. The upper end of the support 1 is attached to the back portion of a bottom **2*c* of the frame member 2. The frame member 2** is formed as, for example, by aluminum die casting, steel plate press working, or synthetic resin forming.

Figure 2:
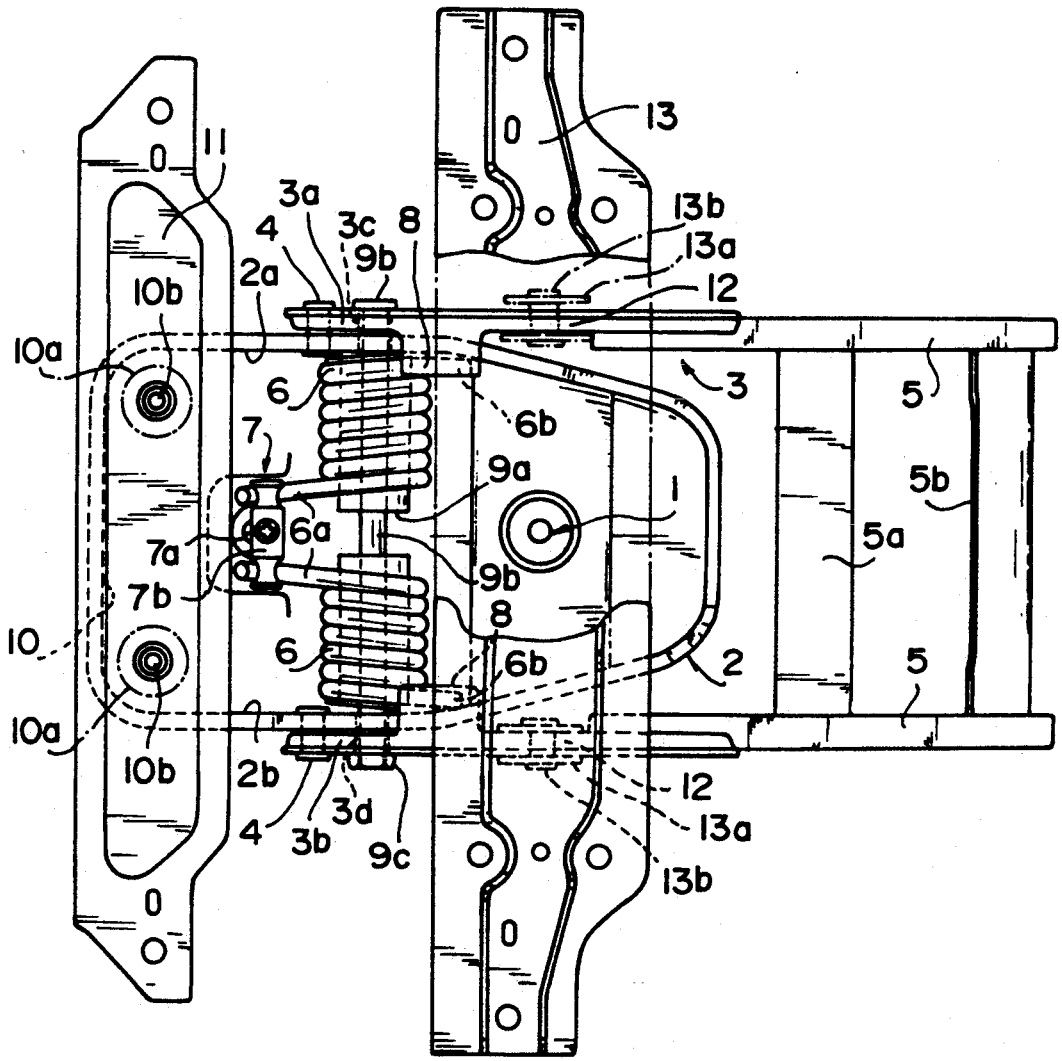
FIG. 2 a plan view of the mechanism shown in FIG. 1.
Figure 3:
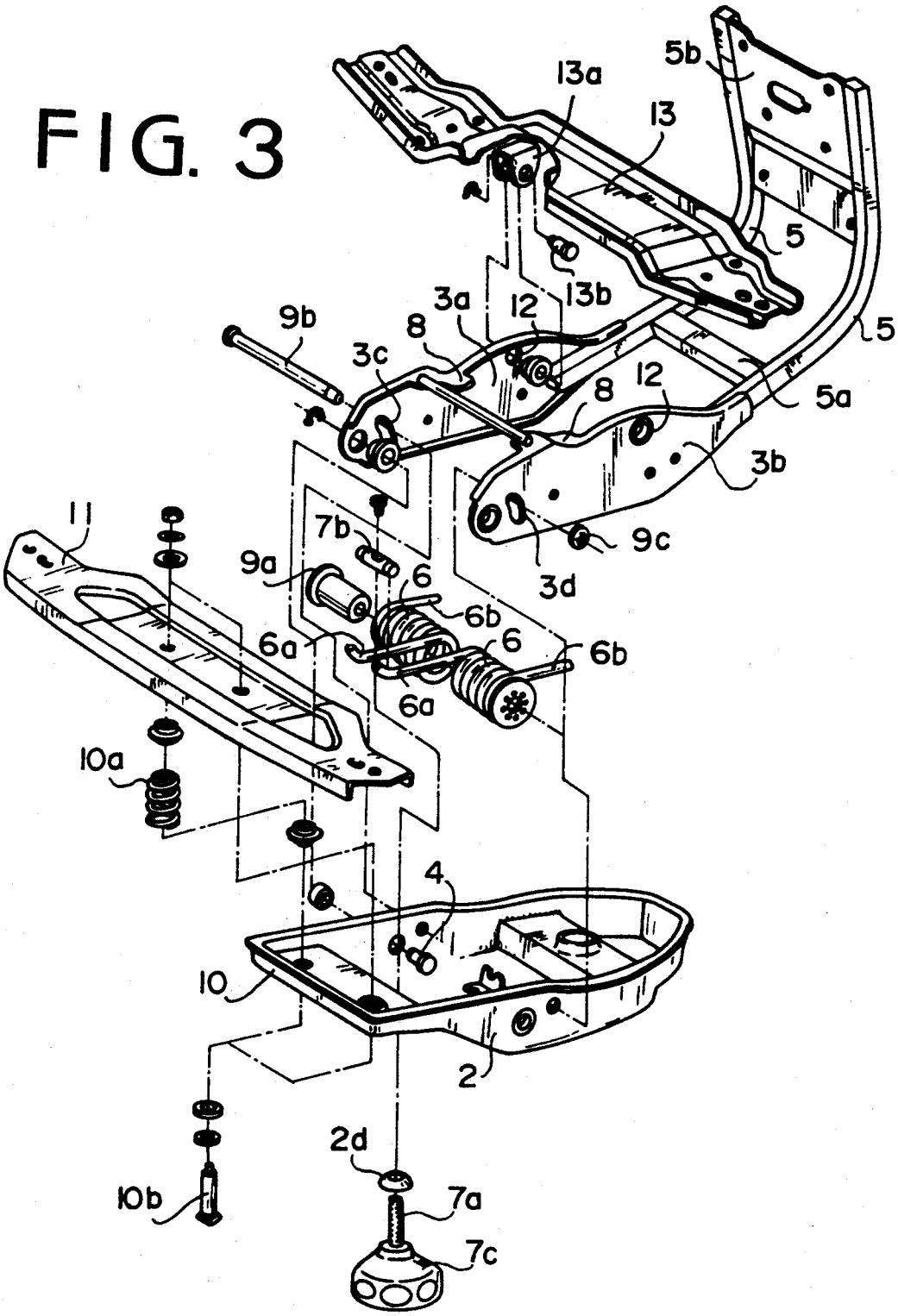
FIG. 3 is a perspective view of components shown in FIGS. 1 and 2.

Numeral 3 denotes a lever member pivotally connected to the frame member 2 by two horizontal shafts 4, which are at the same height, as viewed from the front of the chair. The lever member 3 is connected to the approximate center of the frame member 2. In this embodiment, the back ends of H-like members, as viewed from the top, are connected to two back supporting bars 5 (see FIG. 2). A reinforcing bar **5*a* and a connecting plate 5*b* are disposed between the back supporting bars 5. Side members 3*a* and 3*b* of the lever member 3 are arranged in such a manner as to partially wrap or cover side members 2*a* and 2*b* of the frame member 2. The side members 2*a* and 3*a* on the front portion of the lever member 3 are joined together by one horizontal shaft 4; similarly, the side members 2*b* and 3*b* on the front portion of the lever member 3 are joined together by the other horizontal shaft 4. The lever member 3 is thus attached to the frame member 2 and supported by it so that the lever member 3 can rock on the horizontal shafts 4**.

Numeral 6 denotes two torsion coil springs interposed between the frame member 2 and the lever member 3, which is free to rock with respect to the frame member 2. One end 6*a* of each spring 6 is supported by a spring pressure adjusting mechanism 7, and the other end 6*b* is supported by a spring-receiving portion 8 which is formed on one side member 3*a* or 3*b* of the lever member 3.

Numeral 9 denotes a spring fixing portion for positioning and retaining the two torsion coil springs 6. With the aid of collars 9*a* penetrating through the two coil springs 6, a spring fixing shaft 9*b*, having a screw formed at the tip thereof, penetrates through somewhat oblong holes 3*c* and 3*d* formed at the front portion of the side members 3*a* and 3*b* of the lever member 3. The spring fixing shaft 9*b* is tightened by a nut 9*c*, whereby the torsion coil springs 6 are attached to the inside of the frame member 2.

The spring pressure adjusting mechanism 7 is composed of a spherically-shaped attaching portion 2*d*, a bolt-like shaft 7*a*, a spring pressing member 7*b* and a control knob 7*c*. The attaching portion 2*d* is attached to an outer front portion of the frame member 2. The shaft 7*a* penetrating through the attaching portion 2*d* is screwed into the spring pressing member 7*b* so as to support the pressing member 7*b*. One end of the spring pressing member 7*b* is disposed on one end of one coil spring 6, and the other end is disposed on the other end of the other coil spring 6. The control knob is integrally formed with the lower end of the shaft 7*a*.

When the control knob 7*c* is rotated in one direction as the shaft 7*a* is rotated in the same direction. The spring pressing member 7*b* screwed to the shaft 7*a* is accordingly moved up and down, thereby supporting one end of each coil spring 6 which can thus be tightened or loosened. In this way, the repelling force acting on the coil springs 6 can be adjusted.

In this embodiment, the torsion coil springs 6 are disposed between the frame member 2 and the lever member 3, and the spring force upwardly acting with respect to the lever 3 is always energized about the shafts 4 by the spring pressure adjusting mechanism 7, the spring-receiving portion 8, etc. However, to energize the upward force or upward repelling force with respect to the lever member 3, other than by the coil springs 6 mentioned above, for example, a cam post-like or cam cylinder-like elastic member, not shown, is arranged between the lower portion of the lever member 3 and the bottom 2*c* of the frame member 2. Such an elastic member is made of rubber, and the effective radius thereof is changed stepwise or non-stepwise about the shaft 9*b*.

Numeral 10 denotes a supporting portion for upholding a front seat-receiving member 11. It is shaped like a tongue projecting upwardly at the front portion of the frame member 2. Numeral 12 denotes other supporting portions for upholding a back seat-receiving member 13 which in turn upholds the back of a seat bottom. These supporting portions 12 are formed on the back portions of the side members 3*a* and 3*b* of the lever member 3, and are attached by pins 13*b*, parallel to the shafts 4, to the back seat-receiving member 13. Bracket-like pin-receiving portions 13*a* are formed in positions of the undersurface of the back seat-receiving member 13 where they face the lever member 3. The back seat-receiving member 13 is positioned in the upper back portion of the lever member 3, that is, more specifically, on the center line of the leg support 1. The pins 13*b* of the pin-receiving portions 13*a* allow such positioning. The back seat-receiving member 13 is thus positioned so as to freely rock. The pins 13*b* are positioned on the center line of the leg support 1 because, when a person sits on the seat bottom 14, mentioned later, the tuber ischiadicum point of the person is positioned on or about the center line of the leg support 1. Therefore the supporting portions primarily uphold such a tuber ischiadicum point.

The front seat-receiving member 11 is attached by attaching bars 10*b* with the aid of right-hand and left-hand springs to the obverse surface of the supporting portion 10. Since the obverse surface of the supporting portion 10 inclines upwardly in the front and back directions thereof, the springs 10*a* are provided with force so that the supporting portion 10 inclines forward while the springs 10*a* are more compressed on the front portion than on the back portion thereof These springs 10*a* act to automatically return the front seat-receiving member 11 which is displaced in a rearward direction. Because of the operation of the right-hand and left-hand springs 10*a* and the attaching bars 10*b* therefor, the front seat-receiving member 11 can be freely displaced to some extent in the front, rear, right and left directions with respect to the supporting portion 10. An embodiment of the mechanism according to the present invention is constructed as described above.

The operation of the mechanism according to this invention will now be described when, for example, the seat bottom 14, with which the lower half of a backrest is integrally formed, is attached to the front seat-receiving member 11 and the back seat-receiving member 13. As mentioned above, the front seat-receiving member 11 is attached, with the aid of springs 10*a*, to the obverse surface of the supporting portion 10 of the frame member 2 so that it can move freely. The back seat-receiving member 13 is attached, with the aid of pins 13*b*, to the lever member 3, which can be rocked on the shafts 4 with respect to the frame member 2.

A middle portion 14*c* of the seat bottom 14, supported by the back seat-receiving member 13, can be rocked on the shafts 4 of the lever member 3, to which the back seat-receiving member 13 is attached. When load is applied to, for instance, the middle portion 14*c*, it is transmitted to the lever member 3 through the back seat-receiving member 13 and the pins 13*a*. The spring-receiving portions 8 of the lever member 3 are pressed upwardly by the back ends 6*b* of the torsion coil springs 6. Thereby the above rocking motion (sinking) can be elastically absorbed.

Because the spring fixing shaft 9*b* is supported by the oblong holes 3*c* and 3*d* formed in the lever member 3, when the seat bottom 14 is initially rocked, the sinking motion is absorbed in an amount equal to the length of each oblong hole by the torsional repelling force acting on both ends 6*a* and 6*b* of each spring 6, rather than by the deflective repelling force acting on the springs 6.

However, when the spring fixing shaft 9*b* comes into contact with the upper ends of the holes 3*c* and 3*d*, the sinking of the lever member 3 is absorbed by the repelling forces, mainly composed of the torsional repelling force, of the springs 6. In other words, because the holes 3*c* and 3*d* are oblong, the sinking of the lever member 3 is absorbed by the two types repelling forces acting on the springs 6. For this reason, the sinking is smoothly absorbed when a person sits down in the chair, particularly the moment he is seated.

A front edge 14*f* of the seat bottom 14 and a portion extending from a back portion 14*b* to the backrest are rocked as the middle portion 14*c* of the seat bottom 14 is rocked. The front edge 14*f* is integrally formed with the middle portion 14*c* and is supported by the front seat-receiving member 11. The above portion extending from the back portion 14*b* to the backrest is also integrally formed with the middle portion 14*c*. However, the front edge 14*f* is attached to the front seat-receiving member 11, disposed to move independently of the supporting member 10, and the portion extending from the back portion 14*b* to the backrest is attached to the back supporting bars 5, which move in a range different from the range where other components move. Therefore the range in which the front edge 14*f* moves and that in which the above portion moves are different.

For the above reason, the construction of a shell attached to the mechanism of this invention is desirably such that it moves as the above-mentioned components move. For example, the middle portion 14*c* of the seat bottom 14 is formed by providing ribs or the like to improve stiffness since it mainly receives the sitting load. However, the front edge 14 is formed flexibly enough to freely move as the front seat-receiving member 11 moves, and to be integral with the middle portion 14*c*. Though not shown, slots or the like are formed so that the back portion 14*b* of the seat bottom 14 can move as the back supporting bars 5 rock back and forth, and so that it can be integrally formed with the middle portion 14*c*.

As mentioned above, according to the mechanism of the present invention, the front edge 14*f* of the seat bottom 14 is attached with the aid of the springs 10*a* to the front seat-receiving member 11 so that it can have a range in which it freely moves to some extent back and forth and right and left. Therefore, the front edge 14*f* of the seat bottom 14 and a portion close to it can not only freely move as the middle portion 14*c* is rocked, but also rock independently of the middle portion 14*c*.

On the other hand, because the back supporting bars 5 are rocked greatly on the shafts 4 of the lever member 3, the angle of the back portion 14*b* changes with respect to the middle portion 14*c*. However, the back seat-receiving member 13, supporting the middle portion 14*c* of the seat bottom 14, can be rocked on the pins 13*b*, thereby absorbing such a change.

Because the pins 13*b* are positioned substantially on the center line of the leg support 1, and, as a result, because the center of gravity of a seated person or tuber ischiadicum point, is positioned just above the pins 13*b*, the mechanism of the present invention can be smoothly operated, and enables us to provide a comfortable chair.

Thus in the mechanism of this invention, the middle portion 14*c* of the seat bottom 14, on which the load of a seated person is concentrated, is allowed to sink and recover, instead of being displaced back and forth. The front edge 14*f* and the back portion 14*b* as the middle portion 14*c* moves because of the degree of freedom that the front and back seat-receiving members 11 and 13 have. The front edge 14*f* and the back portion 14*b* are integrally formed with the seat bottom 14, and operate in a manner different from that of the middle portion 14*c*. Therefore when the middle portion 14*c* of the seat portion 14 sinks and recovers, the knees of a sitting person do not rise, or the shirt or other attire is turned up on the backrest.

Figure 4:
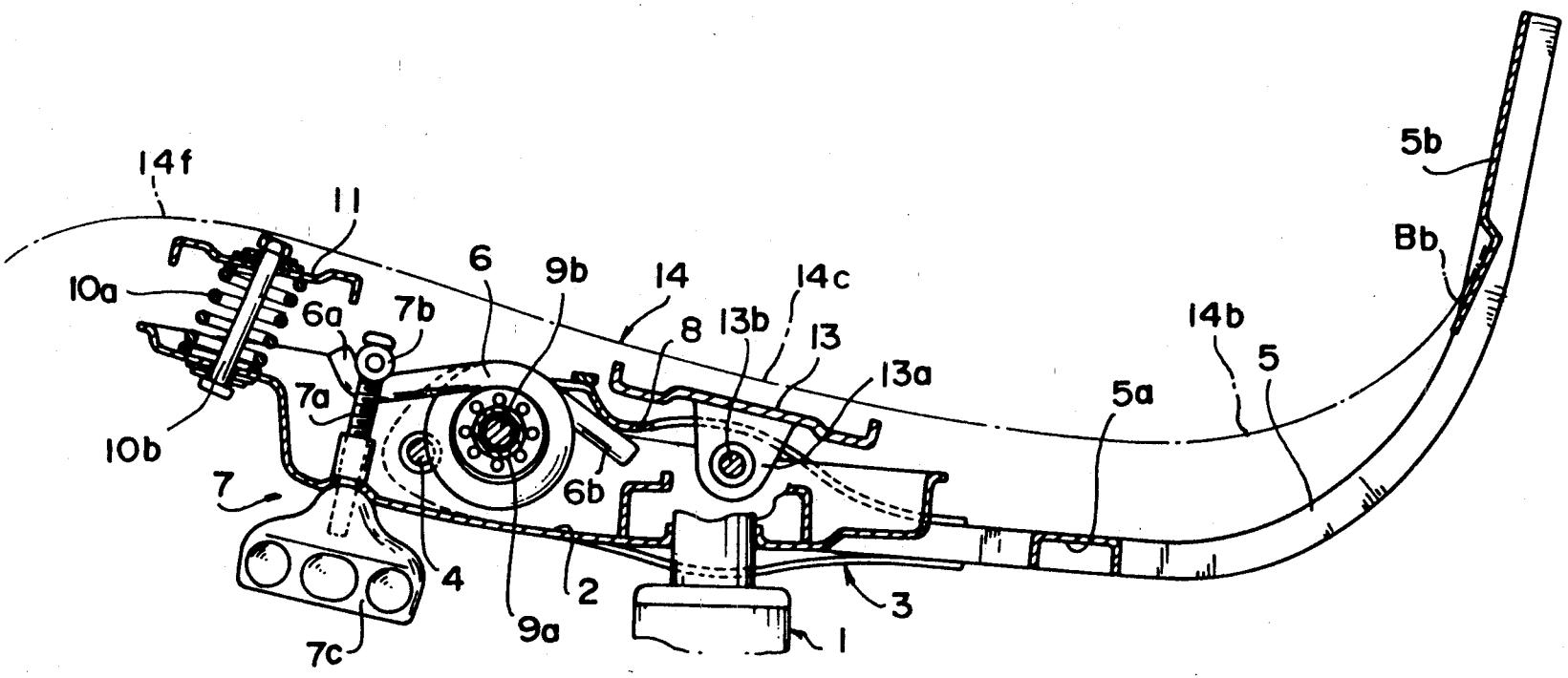
FIG. 4 is a side view showing the mechanism when it is inclined backward.
Figure 5:
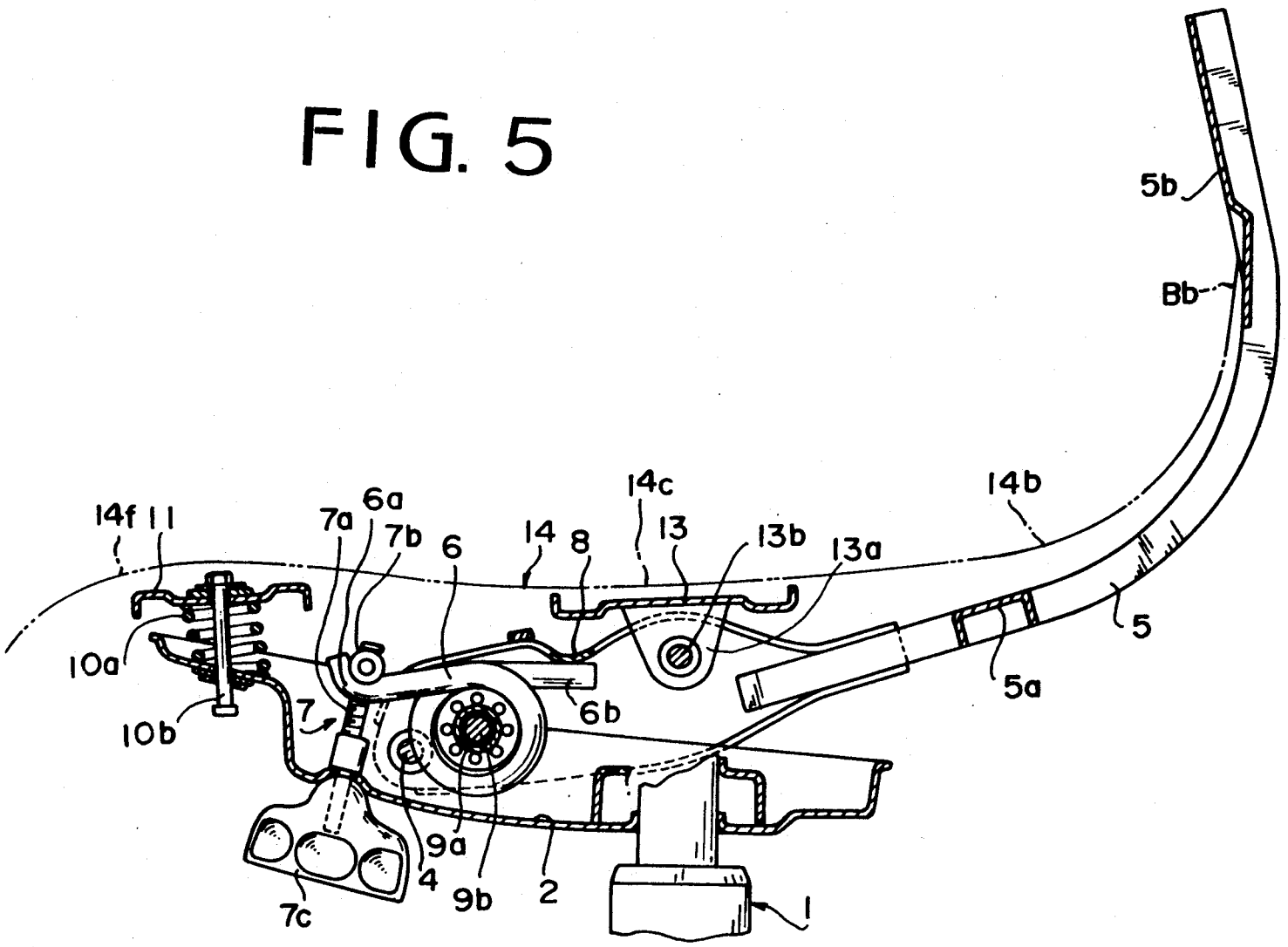
FIG. 5 is a side view showing the mechanism when it is inclined forward.

For example, when a person sits on the seat bottom 14 and leans against the backrest (not shown), the mechanism of this invention is displaced, as shown in FIG. 4. However, even when the back supporting bars 5 incline backward greatly, the back seat-receiving member 13 of the seat bottom 14 inclines backward on the pins 13*b* and is not displaced. The back portion 14*b* bends and thereby absorbing the backward inclination of the back supporting bars 5, whereas the front seat-receiving member 11 is pulled backward and sinks, thereby absorbing the inclination of the middle portion 14*c*.

When a person leans forward, the back supporting bars 5 incline forward greatly, and the back seat-receiving member 13 also inclines forward a little. However, the front seat-receiving member 11 moves forward and sinks, thereby absorbing the displacement of the front edge 14*f* caused by the above inclination of the back supporting bars 5 and the back seat-receiving member 13.

When a person swivels around while seated, the front edge 14*f* of the seat bottom 14 behaves in accordance with such a swivel because the front seat-receiving portion 11, supporting the front edge 14*f*, is provided with a degree of freedom in which the right-hand side of the seat-receiving portion 11 inclines separately from the left-hand side of the same due to the two springs 10*a*. Thus a person can move his body without feeling pressure on his thighs applied by the seat bottom 14.

As has been described above, in accordance with the present invention, it is possible to provide a simply-constructed mechanism for supporting the seat and seat back of a chair. This mechanism moves smoothly as the posture of a seated person changes.

What is claimed is:

1. A support mechanism for a chair comprising:

a frame having two opposing generally vertical sides and a front seat receiving member;

lever means pivotably attached to said vertical sides at a first position near said front seat receiving member of said frame so that said lever means rocks about said first position relative to said frame;

torsional spring means for applying an upward force to said lever means and having a generally horizontal longitudinal axis movably mounted within elongated openings in said lever means at a second position rearward of said first position; and torsion adjusting means for adjusting the upward force provided by said spring means, said spring means comprising a first portion braced against said lever means at a third position rearward of said second position and a second portion braced against said torsion adjusting means forward of said first position, whereby said spring means provides an adjustable upward force to said lever means at said third position.

2. The support mechanism of claim 1 further comprising: range defining means in said lever means at said second position for defining the range of movement of the longitudinal axis of said spring means relative to said lever means, said range defining means allowing the longitudinal axis of said spring means to move generally vertically relative to said lever means.

3. The support mechanism of claim 2 wherein said range defining means comprises a pair of opposing generally oblong openings in said lever means, each of said oblong openings having a major axis extending generally vertically.

4. The support mechanism of claim 1 wherein said front seat receiving member is generally horizontal, and wherein said support mechanism further comprises plural spaced and independently operable compression springs attached to said front seat receiving member, each of said springs having a generally vertical longitudinal axis, for supporting a front portion of a seat of a chair that overlies said front seat receiving member so that said front portion of a seat may have resilient vertical motion.

5. The support mechanism of claim 1 further comprising: a back seat-receiving member pivotably attached to said lever means rearward of said third portion and having a longitudinal axis generally parallel to that of said spring means.

6. The support mechanism of claim 1 wherein said lever means comprises two generally vertical members, each having an overhanging portion at said third position, and wherein said spring means comprises two torsional springs, each having an end braced against said overhanging portion.

7. A support mechanism for a chair comprising:

a frame having two opposing generally vertical sides;

lever means pivotably attached to said vertical sides at a first position on said frame so that said lever means rocks about said first position relative to said frame;

torsional spring means for applying an upward force to said lever means and having a generally horizontal longitudinal axis; and said spring means being movably attached to said frame at a second position rearward of said first position, and said spring means comprising a first portion braced against said lever means at a third position rearward of said second position and a second portion braced against said frame forward of said first position, whereby said spring means provides an upward force to said lever means at said third position, said lever means comprising two generally oblong openings with generally vertical major axes at said second position for defining the range of movement of the longitudinal axis of said spring means relative to said lever means, said openings allowing the longitudinal axis of said spring means to move generally vertically relative to said lever means.

8. The support mechanism of claim 7 wherein said frame further comprises means for adjusting the upward force provided by said spring means to said lever means and said second portion of said spring means is braced against said means for adjusting.

9. A support mechanism for a chair comprising: a frame having two opposing generally vertical sides and a generally horizontal front seat receiving member;

lever means pivotably attached to said vertical sides at a first position near the front of said frame so that said lever means rocks about said first position relative to said frame;

torsional spring means for applying an upward force to said lever means and having a generally horizontal longitudinal axis movably mounted within elongated openings in said lever means at a second position rearward of said first position;

said spring means comprising a first portion braced against said lever means at a third position rearward of said second position and a second portion braced against said frame forward of said first position, whereby said spring means provides an upward force to said lever means at said third position; and plural spaced and independently operably compression springs attached to said front seat receiving member, each of said compression springs having a generally vertical longitudinal axis, for supporting a front portion of a seat of a chair that overlies said front seat receiving member so that said front portion of a seat may have resilient vertical motion.

10. A support mechanism for a chair comprising:

a frame having two opposing generally vertical sides;

lever means pivotably attached to said vertical sides at a first position on said frame so that said lever means rocks about said first position relative to said frame, said lever means comprising two generally vertical members, each having an overhanging portion;

a torsional spring for applying an upward force to each said overhanging portion and having a generally horizontal longitudinal axis; and said torsional spring being movably mounted within elongated openings in said lever means at a second position rearward of said first position, said torsional spring comprising a first end portion braced against one said overhanging portion at a third position rearward of said second position, and a second end portion braced against said frame forward of said first position, whereby said torsional spring provides an upward force to said lever means at said third position; and a back seat-receiving member pivotably attached to said lever means rearward of said third position and having a longitudinal axis generally parallel to that of said torsional spring.

* * * * *

UNITED STATES PATENT AND TRADEMARK OFFICE

CERTIFICATE OF CORRECTION

PATENT NO. : 5,238,294

DATED : August 24, 1993

INVENTOR(S) : Ishi, et al.

It is certified that error appears in the above—identified patent and that said Letters Patent is hereby corrected as shown below:

In the claims, Column 7, line 16, replace "portion" with -- position --.

Signed and Sealed this

Twenty-second Day of March, 1994

Bruce Lehman

*Attest:*

BRUCE LEHMAN

*Attesting Officer*

*Commissioner of Patents and Trademarks*